US007775279B2

(12) United States Patent
Marya et al.

(10) Patent No.: US 7,775,279 B2
(45) Date of Patent: Aug. 17, 2010

(54) DEBRIS-FREE PERFORATING APPARATUS AND TECHNIQUE

(75) Inventors: Manuel Marya, Pearland, TX (US); Wenbo Yang, Sugar Land, TX (US); Lawrence A. Behrmann, Houston, TX (US); Steven W. Henderson, Katy, TX (US); Robert Ference, Sugar Land, TX (US); Brindesh Dhruva, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 6 days.

(21) Appl. No.: 11/957,768

(22) Filed: Dec. 17, 2007

(65) Prior Publication Data

US 2009/0151949 A1 Jun. 18, 2009

(51) Int. Cl.
*E21B 29/00* (2006.01)
*F42D 3/00* (2006.01)

(52) U.S. Cl. ..... 166/297; 166/55.1; 166/55.2; 102/313; 102/307; 102/312

(58) Field of Classification Search ..... 166/297, 166/55.1, 55.2, 85.5; 102/313, 307, 312, 102/378, 306, 506, 517, 310
See application file for complete search history.

(56) References Cited

U.S. PATENT DOCUMENTS 2,931,743 A * 4/1960 Rittmann ..... 438/352
3,650,212 A * 3/1972 Bauer ..... 102/310
4,969,525 A * 11/1990 George et al. ..... 166/297
5,049,329 A * 9/1991 Allaire et al. ..... 264/570
5,241,614 A * 8/1993 Ecker et al. ..... 385/94
6,216,596 B1 * 4/2001 Wesson ..... 102/312
6,386,109 B1 5/2002 Brooks
6,464,019 B1 * 10/2002 Werner et al. ..... 175/4.6
6,497,285 B2 12/2002 Walker
6,554,081 B1 4/2003 Brooks
6,619,176 B2 9/2003 Renfro
6,896,059 B2 5/2005 Brooks
7,159,657 B2 1/2007 Ratanasirigulchia
7,287,589 B2 10/2007 Grove
2006/0102352 A1 5/2006 Walker
2006/0108148 A1 5/2006 Walker
2007/0181224 A1 * 8/2007 Marya et al. ..... 148/400
2008/0003125 A1 * 1/2008 Peterson et al. ..... 419/8
2008/0105438 A1 * 5/2008 Jordan et al. ..... 166/376

* cited by examiner

*Primary Examiner*—Jennifer H Gay
*Assistant Examiner*—Yong-Suk Ro
(74) *Attorney, Agent, or Firm*—Kevin B. McGoff; Rodney Warfford

(57) ABSTRACT

An apparatus that is usable with a well includes a perforating system that is adapted to be fired downhole in the well. The perforating system includes a component, which includes an alloy that has a negative corrosion potential and is unable to passivate, or self-protect, while deployed in the well. The component is adapted to disintegrate to form substantially no debris in response to the firing of the perforating system.

23 Claims, 7 Drawing Sheets

FIG. 5

| 160 MATERIAL | VICKERS HARDNESS NUMBER | ESTIMATED STRENGTH | | | REACTIVITY IN WATER* | POTENTIAL IN V** | DISSOLUTION RATE IN DISTILLED WATER AT 25°C |
|---|---|---|---|---|---|---|---|
| | | (MPa) | (Ksi) | (NORMALIZED) | | | |
| (1) PURE CALCIUM | 23.1 | 69.2 | 10.3 | 1.00 | 4 | -1.12 | 0.1 g/min. |
| (2) PURE ALUMINIUM | 33.1 | 99.4 | 14.9 | 1.44 | 0 | -0.60 | DOES NOT DISSOLVE UNLESS pH IS REDUCED |
| (3) PURE MAGNESIUM | 32.6 | 97.7 | 14.6 | 0.98 | 0 | | DOES NOT DISSOLVE UNLESS pH IS REDUCED |
| (4) 80Al-20Ga | 31.0 | 93.0 | 13.9 | 1.34 | 1 | -1.02 | INITIALLY REACTS AND PITS OVER TIME BUT DOES NOT DISSOLVE RAPIDLY |
| (5) 80Al-10Ga-10Bi | 33.6 | 100.7 | 15.1 | 1.46 | 1 | -1.28 | REACTS SLOWLY BUT DOES NOT DISSOLVE |
| (6) 80Al-10Ga-10In | 33.4 | 100.2 | 15.0 | 1.45 | 4 | -1.48 | ~1 g/min. DEGRADED; GRANULAR RESIDUE |
| (7) 80Al-10Ga-10Zn | 41.8 | 125.5 | 18.8 | 1.81 | 1 | -1.15 | REACTS SLOWLY BUT DOES NOT DISSOLVE UNLESS pH IS REDUCED AND/OR TEMPERATURE INCREASED |
| (8) 80Al-10Ga-10Mg | 107.9 | 323.7 | 48.4 | 4.68 | 1 | -1.30 | REACTS SLIGHTLY, DOES NOT DISSOLVE UNLESS pH IS REDUCED |
| (9) 80Al-5Ga-5Zn-5Bi-5Sn | 33.7 | 101.0 | 15.1 | 1.46 | 4 | -1.28 | ~1-2 g/min. DEGRADED |
| (10) 75Al-5Ga-5Zn-5Bi-5Sn-5Mg | 40.1 | 120.2 | 18.0 | 1.74 | 4 | -1.38 | ~1 g/min DEGRADED |

* REACTIVITY IN AIR WAS ASSESSED BY THE RATE OF DARKENING AFTER SAMPLE POLISHING; REACTIVITY IN WATER WAS ASSESSED BY THE RATE OF DEGRADATION (0- LEAST; 4 MOST REACTIVE)

** POTENTAL MEASURED IN 5 wt.% NaCl DISTILLED WATER AT 25°C WITH REFERENCE TO A PURE COPPER ELECTRODE (ERROR IN MEASUREMENT ESTIMATED AT 10%)

DEBRIS-FREE PERFORATING APPARATUS AND TECHNIQUE

BACKGROUND

The invention generally relates to the field of oilfield exploration, production, and testing, and more specifically, to the use of materials designed to create debris-free perforating apparatus and techniques for enhanced hydrocarbon recovery.

For purposes of enhancing fluid communication between wellbore and geological rock formation containing hydrocarbons, holes are punched from the wellbore to the rock formation during operations, known in the oilfields as perforating operations. More specifically, during these operations a long and tubular device called a perforating gun is run into the wellbore in preparation for production. After the perforating gun has been deployed at its appropriate position downhole, perforating charges (shaped charges, for example) contained within the perforating gun are fired. As a result of firing these shaped charges, extremely high-pressure jets capable of opening perforation tunnels through both casing and liner (if the wellbore is cased) are produced, and a skin of the surrounding rock formation is then made more permeable for releasing its hydrocarbons.

The shaped charges are designed so that a cavity-effect explosive reaction is produced and focused in a high-pressure and high-velocity jet that can force materials, such as steel (casing), cement and rock formations, to fracture and then flow plastically around the jet and effectively open a perforation tunnel. Shaped charges may be classified according to the tunnel depth their perforation jet forms and the tunnel cross-sectional diameter (called the "hole size") at its entrance. One type of shaped charge, referred as a "big hole" shaped charge, produces a relatively large-diameter hole in the casing and has a relatively shallow penetration depth into the rock formation. Such "big hole" shaped charges are commonly employed in sand control applications. Another type of popular shaped charge is a "deep penetrating charge." Such a shaped charge leaves a relatively smaller-diameter hole in the well casing but has the advantage of penetrating relatively farther into the geological rock formation. The greater penetration depth associated to these charges is hugely beneficial to extend well fluid communication past any damage zone (caused by drilling of the wellbore), and it also tends to significantly enhance well productivity. Deep penetrating charges are employed in natural completion applications.

The shaped charges may be contained either inside a tubular member as part of a hollow carrier perforating gun or may be individually encapsulated. In order to prevent deteriorating the explosives contained within the shaped charges due to inadvertent contact with well fluids, each shaped charge is sealed by a corresponding cap. By being more massive, the encapsulated shaped charges tends to produce significantly more debris than the same size charges that are carried by a hollow carrier perforating gun. The encapsulated charges also tend to generate larger diameter holes in the casing that extend deeper into the geological rock formation.

The firing of the perforating gun results in debris from both the shaped charges and other parts of the gun located in close proximity to the explosives. Though the debris is largely contained within the perforating gun and the wellbore, some debris is inescapably introduced into the rock formation. In situations where significant debris (in particular from the shaped charge liner) reaches the rock formation, the productivity of the well may be hindered, resulting in a problem often referred as "skin damage". To mitigate the detrimental consequences of debris left in the perforating tunnel, perforating is generally conducted underbalanced (i.e., in conditions wherein the wellbore possesses a lower pressure than the formation pressure) since a higher formation pressure causes debris to evacuate with the formation fluids surged into the well. Today, other methods of stimulation such as acidizing and propellent fracturing are often used for purposes of overcoming this damage and bringing the well up to its full potential. If not property conducted, perforating debris may induce significant losses with regard to time and cost operating the well. As example, an extra intervention may be needed in the well to remove debris from a fractured zone. Of considerable concern to a field operator, the debris may cause additional damage to the well, such as damage caused to a packer elastomer seal or damage due to the clogging of a downhole choke, for example.

Thus, there is a continuing need for new and/or improved solutions to minimize the amount of debris in a well and therefore, offer new and improved perforating operations.

SUMMARY

In an embodiment of the invention, an apparatus that is usable with a well includes a perforating system that is adapted to be fired downhole in the well. The perforating system includes a component that incorporates an alloy having a negative corrosion potential and being unable to passivate, and the component adapted to disintegrate to form substantially no debris in response to the firing of the perforating system.

In another embodiment of the invention, a method that is usable with a well includes providing a perforating system downhole in the well and firing at least one perforating charge of the perforating system. In response to the firing of the perforating charge(s), a component of the perforating system, which has an alloy with a negative corrosion potential and having the inability to passivate is disintegrated.

Advantages and other features of the invention will become apparent from the following drawing, description and claims.

BRIEF DESCRIPTION OF THE DRAWING

FIG. 5 is a table comparing characteristics of several selected pure metals with that of experimental anodic alloys specifically formulated to degrade in neutral aqueous environments, including perforating well fluids (e.g. brines such as chlorides), according to embodiments of the invention.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
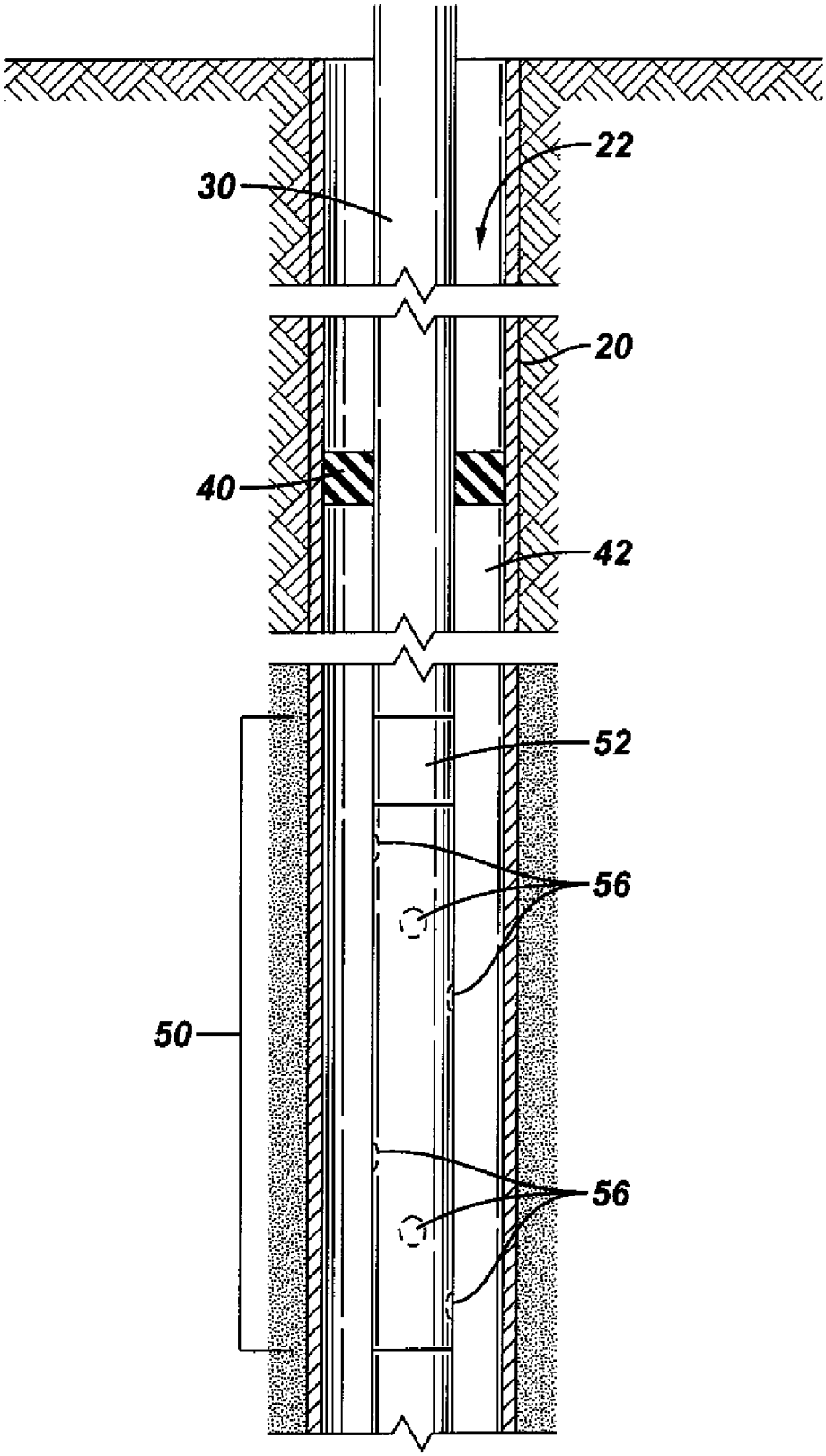
FIG. 1 is a schematic diagram of a well illustrating a hollow carrier gun-based perforating system according to an embodiment of the invention.

Referring to FIG. 1, for purposes of perforating a particular segment of an oil or gas well, a perforating system is run into a wellbore 22 to the appropriate position, and the perforating charges of the system are subsequently fired, then causing the charges to disintegrate. As described herein, the perforating system is constructed with materials that are designed to leave substantially zero debris in the well after the firing of the perforating charges. More specifically, in accordance with embodiments of the invention described herein, components (such as perforating charge components, for example) of the perforating system are constructed from an anodic material that is designed to degrade at a relatively rapid rate and leave zero debris in the well (as described below, this material is often referred as a "debris-free anodic material"). In the context of the application, "zero debris" means that the debris is fully dissolved and/or broken into tiny fragments that are characterized as being harmless (as inexistent) and of no negative influence on well operations because the fragments have sizes smaller, and if not at least comparable to that of sand grains (sand particles are submillimeter size and typically range in diameters from 0.0625 (or 1/16 mm) to about 1 mm). In the context of the application, the absence of debris, as defined herein, is due to the use of materials that are designed to be anodic and non-passivating (i.e. non-protecting) as well as the presence of a water-containing fluid (a brine for instance), even when this fluid is non-acidic (i.e. neutral water). Materials that either dissolve (i.e. goes into solution into a solvent fluid that may be represented by the well fluid), break into tiny sand-like fragments (i.e. selectively dissolved to cause tiny fragments to be generated), or both dissolve and break into fragments are referred as "degradable" materials herein. In circumstances where the degradation simply takes the form of a dissolution, the two words "dissolvable" and "degradable" are inter-changeable. However, in circumstances where for instance the materials are largely non-soluble but fragment from within internal boundaries (e.g. grain boundaries), the word "fragmentable" is far more appropriate. "Degradable" is a broad generic term that describes all types of degradations: dissolution, fragmentation, etc.

The perforating system, in accordance with some embodiments of the invention, includes a perforating gun 50 (depicted in FIG. 1 in a state before the gun 50 is fired) that is run downhole on a tubular string 30 (a coiled tubing string or a jointed tubing string, as examples) or on another conveyance mechanism, such as a slickline or wireline, in accordance with other embodiments of the invention. The tubular string 30 extends downhole inside the wellbore 22 of the well, and the wellbore 22 may be lined with and generally supported by a casing string 20 (as depicted in FIG. 1). The wellbore 22 may alternatively be uncased, in accordance with other embodiments of the invention.

Among its other features, the string 30 may include, as an example, a packer 40 for purposes of sealing off an annulus 42 between the tubular string 30 and the casing string 20 prior to the firing of the perforating gun 50.

In general, the perforating gun 50 may include a firing head 52, which is constructed to respond to stimuli communicated from the surface of the well for purposes of directing the firing of perforating charges, such as shaped charges 56, of the perforating gun 50. More specifically, the stimuli may be in the form of an annulus pressure, a tubing pressure, an electrical signal, pressure pulses, an electromagnetic signal, an acoustic signal. Regardless of its particular form, the stimuli may be communicated downhole and detected by the firing head 52 for purposes of causing the firing head 52 to ignite the shaped charges 56 and thus, fire the perforating gun 50.

As an example, in response to a detected fire command, the firing head 52 may initiate a detonation wave on a detonating cord (not depicted in FIG. 1) of the perforating gun 50 for purposes of firing the shaped charges 56. The shaped charges 56 may be arranged in one of numerous different phasing patterns (a helical or spiral phasing pattern, an inline phasing pattern, an interrupted arc phasing pattern, a planar phasing pattern, etc.), depending on the particular embodiment of the invention.

The perforating gun 50 is depicted in FIG. 1 as being a hollow carrier perforating gun, in that the shaped charges 56 are located inside a tubular housing and are isolated from the annulus 42 (and wellbore fluid) prior to the firing of the charges 56. However, the perforating gun may include encapsulated shaped charges, in accordance with alternative embodiments of the invention.

Figure 2:
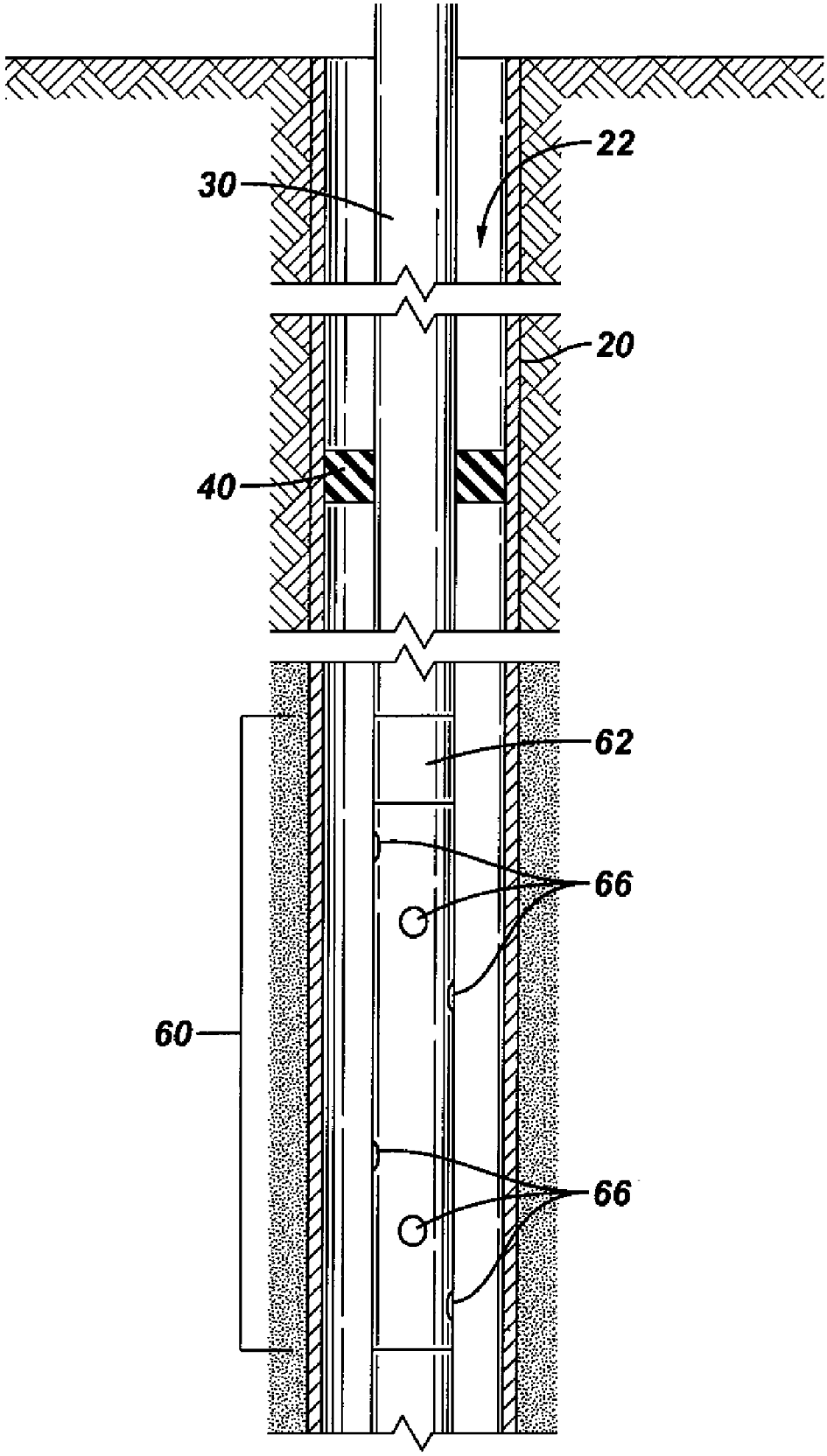
FIG. 2 is a schematic diagram of a well illustrating an encapsulated charge-based perforating system according to an embodiment of the invention.

For example, referring to FIG. 2, in accordance with some embodiments of the invention, the perforating gun 50 of FIG. 1 may be replaced by perforating gun 60, which includes a firing head 62 that directs the firing of encapsulated shaped charges 66. Each of the encapsulated shaped charges 66 is generally exposed to the wellbore fluid but the internal components (such as the explosive(s) and liner) of the shaped charge 66 are enclosed by a cap, as further described below, to isolate the internal components from the wellbore fluid prior to the firing of the charge 66.

Regardless of the particular form of the perforating system that is used, the perforating system includes components that are designed to leave substantially zero debris in the well after the firing of the system. More specifically, in accordance with embodiments of the invention, these components contain materials that may be characterized as being anodic with respect to common engineering materials and immune to building a passive, long-lasting, and protective film.

In the context of this application, an "anodic" material is a material that possesses a corrosion potential lower than that of common engineering materials, for instances commercial steels and aluminum alloys. Therefore, when the anodic material is electrically connected to such steels and aluminum alloys while exposed to an aqueous environment the anodic material degrades providing the absence of corrosion inhibitors. The byproduct of this degradation may be characterized as non-metallic (e.g. hydroxides, oxides though containing ionically bound metallic elements)

Figure 3:
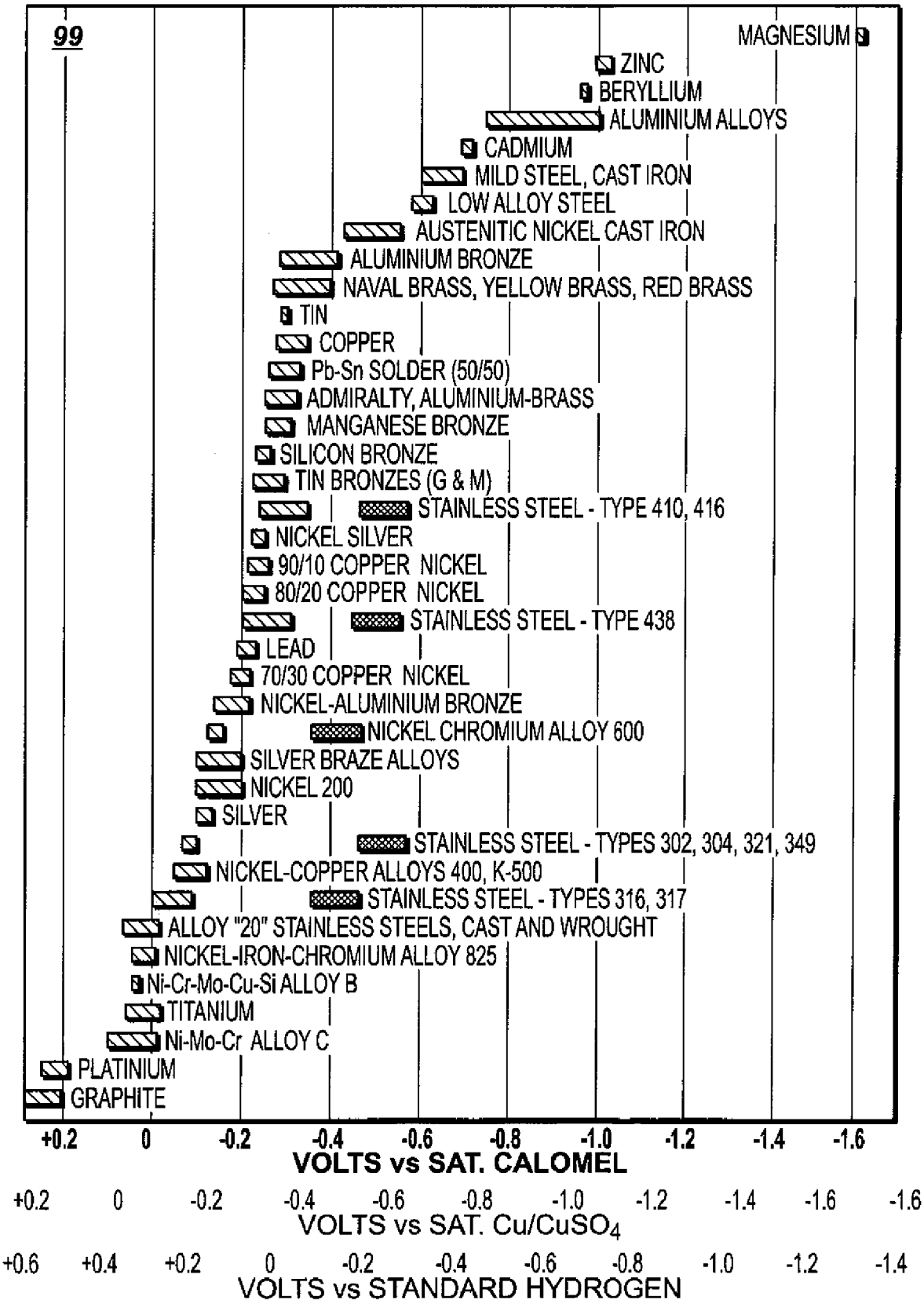
FIG. 3 is a chart depicting the corrosion potentials of various metals and common alloys.
Figure 4:
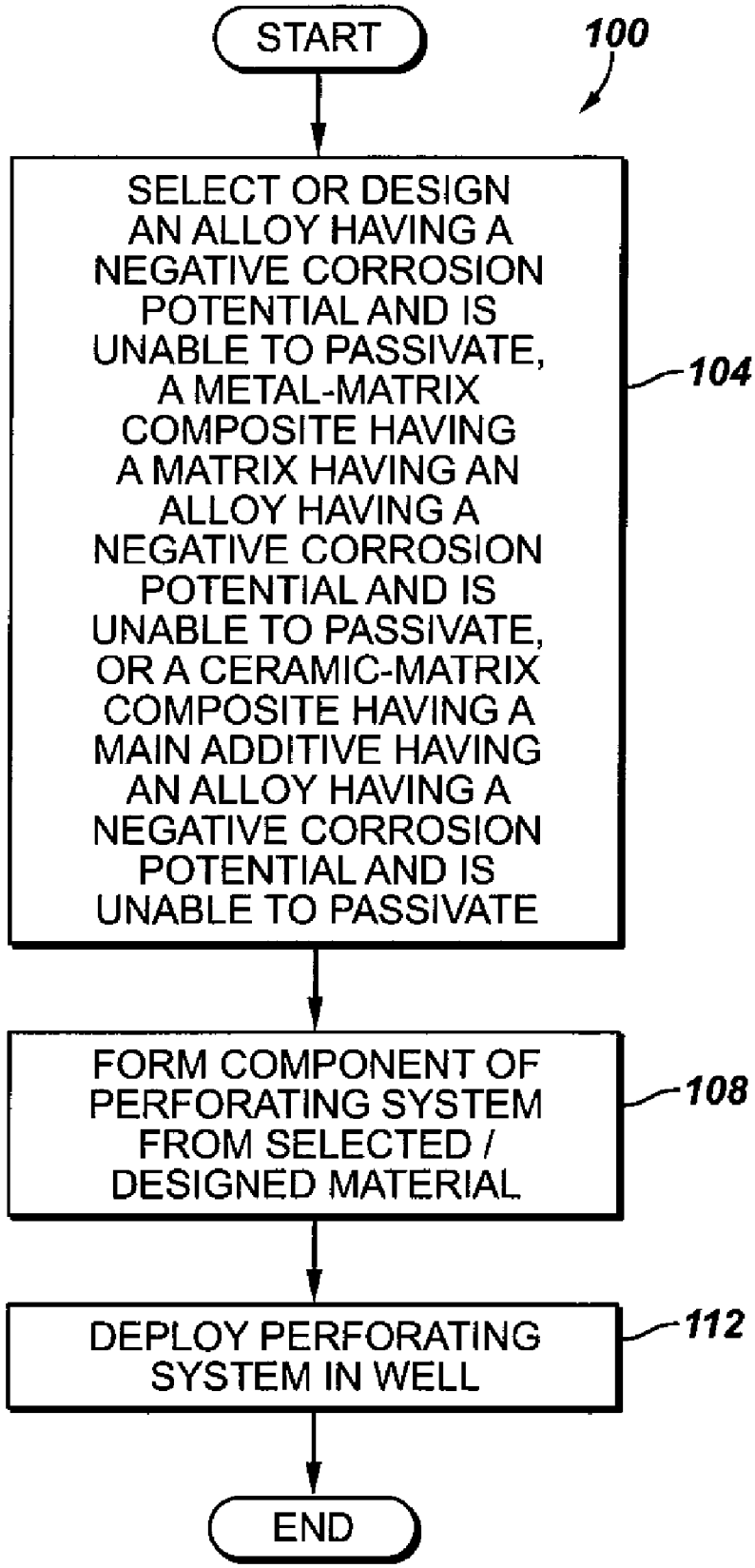
FIG. 4 is a flow diagram depicting a technique to reduce perforating debris in a well according to an embodiment of the invention.

FIG. 3 is an informative chart 99 that compares corrosion potentials of a number of metals and alloys, as measured under various conditions (indicated on horizontal axis). Toward the right of FIG. 3 are found metallic materials (metals) with negative corrosion potentials such as beryllium, zinc and magnesium. Not listed on the chart and located to the right of magnesium would be alkaline metals such as calcium or lithium for instance. In the context of this application, any metallic materials (i.e. metals, alloys and composites thereof) located to the right of aluminum on FIG. 4 are considered to be anodic, as they all exhibit a corrosion potential below approximately −0.5 to −1.0V on the shown scale.

By being anodic, the materials described herein are intrinsically metallic in nature and may also be characterized as being reactive. In this context, the term "reactive" extends beyond the metals in the two first rows of the periodic table, namely the alkaline and alkaline-earth metals. For instance, aluminum and possibly iron (the fundamental ingredient in steels), once properly alloyed and processed, may be also considered to be "reactive". With proper alloying, such metals may be designed to avoid forming any stable (durable) protective oxide, hydroxide, and other like protective non-metallic films, as conventional commercial alloys do, and may furthermore develop intra-galvanic cells that self-consume the material, even in a benign environment such as neutral water (i.e. without addition of one or several acids so that pH is about 7.0).

In the presence of water, including neutral water, the anodic materials that are described herein degrade at various rates. The rate of degradation depends upon intrinsic thermodynamic variables such as temperature and pressure, as well as other variables, including the fluid to which the material is exposed, its composition, and often more important the chemical composition and internal structure (developed in particular by processing, for instance heat treatment) of the material, as well as the presence of an electrical link to a more cathodic material (e.g. a steel). Materials are described herein that, in accordance with some embodiments of the invention, are designed to avoid forming a passive (protective) layer, even in a very benign environment like distilled (e.g. halide-free) neutral water. In accordance with embodiments described herein, the materials are therefore such that they do not protect themselves effectively against their surrounding. Commercial alloys of aluminum, iron (e.g. steels, stainless steels), nickel, and so on rapidly develop stable (durable) oxides, hydroxides or other semi-metallic like layers that impede them from further degradation. The materials that are disclosed herein are considerably different because they are not capable of developing such immunity that commercial alloys are required to acquire, when for instance exposed to a fluid as friendly as water. Additionally, as described herein, the materials, although designed to form zero debris, may be further improved in strength, density and apparent elastic moduli: three important material properties that in perforating primarily affect jet formation and penetration depth, and thus, performance of a perforating operation.

Because the materials that are described herein are either anodic by nature, or intentionally made more anodic by design, in aqueous fluids hydrogen gas normally evolves and may be expected even under the high pressure and high temperature seen downhole a hydrocarbon well. It also follows that metallic components that are galvanically coupled to the anodic materials described herein may potentially be at risk of being cathodically (hydrogen) charged and therefore, may subsequently crack under applied or residual tensile stresses, if countermeasures are not properly planned; for instance, electrically insulating the anodic materials from other metallic tools using insulating plastics, elastomers, or ceramics. However, in accordance with embodiments of the invention, for purposes of preventing this type of cracking, the materials are selected to create basic and alkaline environments.

More specifically, when the anodic materials that are described herein degrade (dissolves) in an aqueous environment, the pH of this environment increases, possibly reaching values culminating nearby 10 or 11 in environments that are for instance contained (e.g. like in stagnant fluids). As more of the materials degrade and cause this environment to gradually become saturated and eventually supersaturated, the precipitation of hydroxides follows at pH values closer to 10 or 11. Practically, this means that the gradual degradation (dissolution) of the materials removes hydrogen (protons and gas) from the aqueous environment. Even if hydrogen charging is to proceed on the cathodic side of an established galvanic circuit, given the life expectancy of the zero debris and anodic material and the relatively high downhole temperature (which makes hydrogen particularly diffusible in downhole alloys), proper conditions for cracking the downhole alloys can hardly be established. Furthermore, when also exposed to environments that have low concentrations of chloride ions, are anaerobic (de-aerated), and non-stagnant (flowing conditions), the anodic materials that are described herein present no risk to the alloys of the permanent downhole completion.

Turning to the more specific details, in accordance with embodiments of the invention, three types of materials (that are hereinafter referred to as "debris free anodic materials") may be used with the intent to produce substantially zero perforating debris: 1.) an alloy designed with a negative corrosion potential that is also not capable of forming a durable passive layer (i.e., the material is not able to self-protect); 2.) a metal-matrix composite designed with a matrix that comprises a metal or alloy of negative corrosion potential that also does not possess the ability to passivate (self-protect); and 3.) a ceramic-matrix composite designed with a main additive that contains a metal or alloy of negative corrosion potential that also does not possess the ability to passivate (self-protect). The debris free anodic materials are described in greater details below.

Referring to FIG. 4, to summarize, a technique 100 in accordance with some embodiments of the invention includes, pursuant to block 104, selecting or designing one of the following materials: an alloy of negative corrosion potential, which is unable to passivate (self-protect); a metal-matrix composite having a matrix consisting of a metal or alloy that has both a negative corrosion potential and is unable to passivate (self-protect); or a ceramic-matrix composite with a main additive having both a metal or alloy that has a negative corrosion potential and is unable to passivate (self-protect). A component (such as a shaped charge case, liner, cap and/or explosive, as examples) of the perforating system is formed (block 108) from the selected/designed material, and the perforating system is deployed in the well, pursuant to block 112. It is noted that multiple components (components of all of the shaped charges, all of the components of each shaped charge, a firing head housing plug, etc.) of the perforating system may be formed from such materials, as further described below.

In accordance with some embodiments of the invention, the debris free anodic material is an alloy that has a negative corrosion potential and the inability to passivate (self-protect). For example, the alloy may have a corrosion potential that is comparable with or less than that of aluminum, in accordance with some embodiments of the invention.

A table 160 that is depicted in FIG. 5 provides examples of experimental materials along with their corrosion potentials, as measured against a pure copper electrode in distilled (halide-free) neutral water at ambient temperature (about 25° C.) and pressure (1 atm). The debris free anodic materials may be aluminum alloys incorporating gallium and indium as alloying elements enabling the degradation to proceed in water-containing environments, and may optionally include metallic alloying elements such as tin and/or bismuth, among a number of other alloying elements. Additional alloys that also exhibit both negative corrosion potentials and the inability to passivate (self-protect) may be designed for an optimal balance of degradation rates (depends upon well environments) and mechanical properties, in particular strength and toughness (impact resistance). Although the optimal materials for perforating applications may not be listed in FIG. 5, the key alloying elements to achieve anodic behavior and degradation in aluminum in accordance with some embodiments of the invention, are listed in Table 5.

Figure 6:
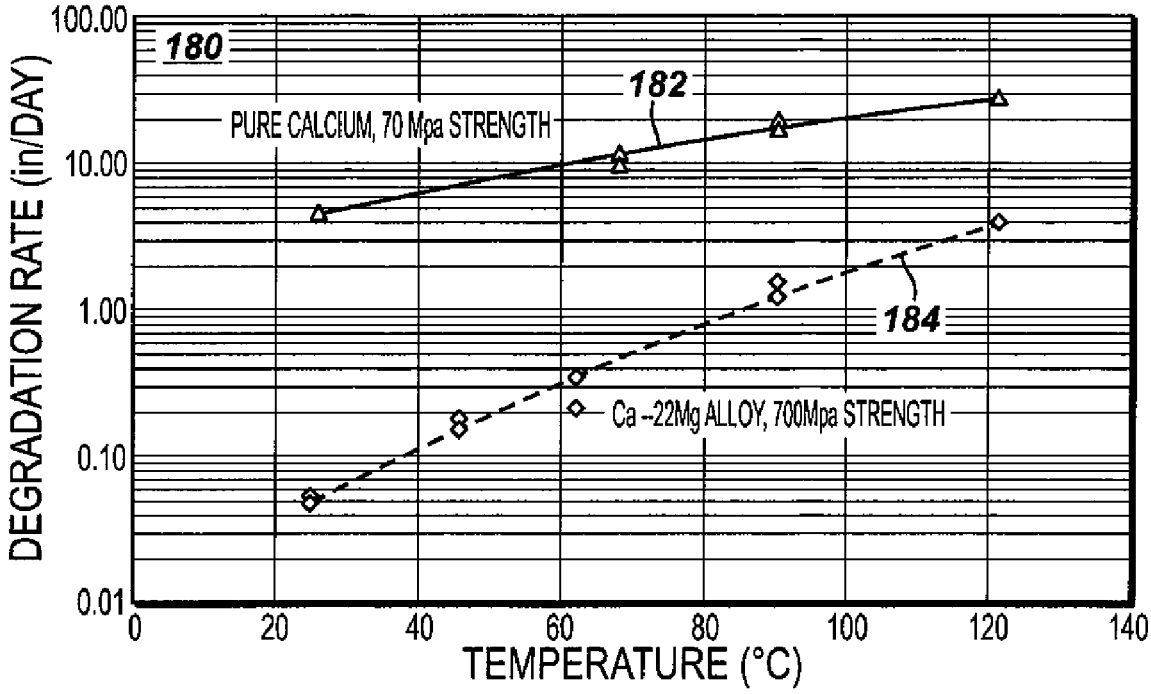
FIG. 6 is chart depicting measured degradation rates of calcium metal and a calcium alloy specifically formulated to exhibit high strength and reduced degradation in water versus temperature according to embodiments of the invention.

As additional example in accordance with some embodiments of the invention, the debris free anodic materials may include materials such as calcium alloys as well as materials that incorporate calcium or any other alkaline element or phase that compares to calcium in hazard ranking (safety). Table 180 in FIG. 6 depicts degradation rate, as measured in distilled water, as a function of temperature for pure calcium (plot 182) and for a calcium alloy (plot 184) containing 22 weight percent magnesium. For the plots 182 and 184, the water pH varied between 2 and 14 and was not found to influence measurably the degradation (dissolution) rates. Other suitable calcium alloys may contain aluminum or zinc as primary alloying element to primarily increase mechanical property while still achieving a rapid degradation in neutral water for instance. The degradation rate of calcium alloys may be orders of magnitude greater than that of the aluminum alloys of FIG. 5, depending on the particular embodiment of the invention.

As additional examples, other materials that have negative corrosion potentials and may be also considered debris-free include magnesium-lithium type alloys (e.g. LA141, LZ145, LA91 for instance). Other materials may also include transition-metal alloys like ferrous alloys. Such materials or alloys must be intentionally alloyed (enriched with alloying elements) and processed to not passivate, or protect themselves from the well environments. Such materials or alloys may be useful in situations where other combinations of strengths, toughness, and especially degradation rates are demanded. In that aspect, these other alloys may be seen as complementary to the calcium alloys and the degradable aluminum alloys previously described. When ferrous alloys are intentionally made degradable, they should exclude alloying elements such as chromium, molybdenum, and nickel. Like the calcium and the aluminum alloys previously listed, these ferrous alloys may be produced by casting, powder-metallurgy routes, or other near-net shape manufacturing processes. Heat-treating may also be employed to optimize specific properties of the alloys, depending upon conditions of use.

In accordance with some embodiments of the invention, the debris free anodic material may be a metal-matrix composite or a so-called "cermet" (i.e., a ceramic-metal composite wherein the metal serves as binder or matrix, while the ceramic serves as reinforcement), wherein the matrix is composed of a metal or alloy characterized by having both a negative corrosion potential and the inability to passivate (self-protect). As examples, the matrix of the composite may contain some of the alloys previously described, such as, in particular, aluminum, calcium, or other degradable alloys. By being a composite, the material also contains additives, in particular discontinuous phases such as powder and particulates that are intentionally added to impart certain properties to the composite material. If, for example, the density of the debris free anodic material is to be controllably raised, as needed by certain perforating applications, a heavy transition metal like tungsten or tantalum, and/or semi-metallic phases or compounds of such heavy-transition metal elements like carbides, nitrides, carbo-nitrides, and/or oxides (e.g. tungsten nitride) may be incorporated at the appropriate proportions to an aluminum-gallium or calcium alloy for instance.

Figure 7:
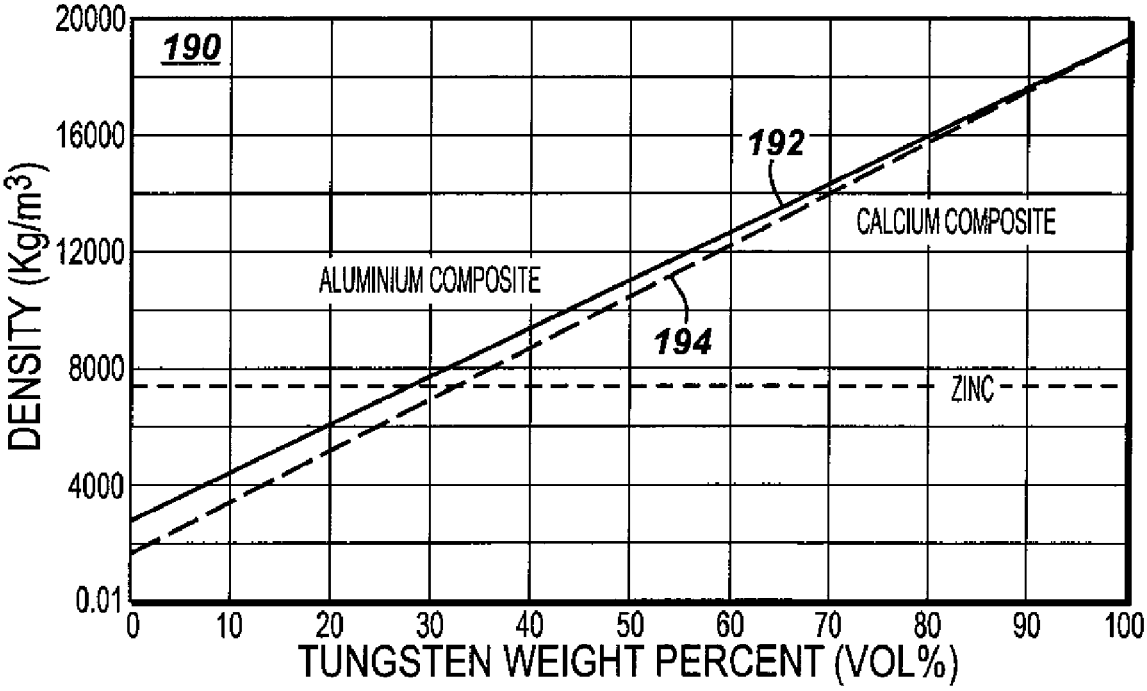
FIG. 7 is a chart depicting calculated densities (based on a rule of mixture) of an aluminum-tungsten composite and a calcium-tungsten composite versus a tungsten weight percentage according to embodiments of the invention.

FIG. 7 is a chart 190 that depicts a plot 192 of density versus tungsten weight percent for a tungsten-aluminum composite and a plot 194 of density versus tungsten weight of a tungsten-containing calcium composite. FIG. 7 well illustrates that increasing the fraction of the heavy phase (e.g. tungsten) in this binary composite reduces the relative influence of the matrix as density becomes increasingly and dominantly influenced by the tungsten. At 50% tungsten for instance, densities of composites incorporating of aluminum-gallium or calcium are about similar while densities of these two alloys substantially differ. Such composite materials with elevated density have attractive usage for shaped charge casings, wherein density is essential to improve perforating, in particular increasing perforating depth.

Figure 8:
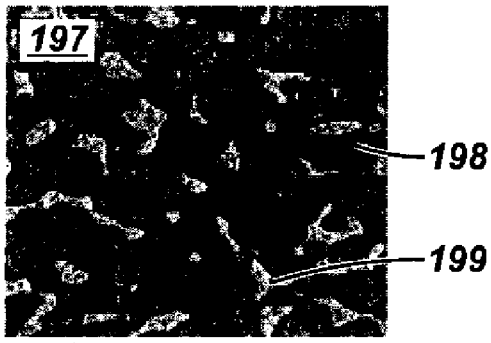
FIG. 8 is an illustration of a microstructure of a metal-matrix composite according to an embodiment of the invention.

FIG. 8 schematically illustrates a microstructure 197 well representing what a tungsten-aluminum composite might resemble if examined at higher magnification. In particular, the microstructure 197 includes two phases 198 and 199, one which may be made of tungsten or other heavy (dense) phase. Additives other than tungsten may be added to the matrix, such as boron, silicone carbide, alumina, alumina-silica or boron carbide (as examples), with the primary purpose of adding strength to the composite rather than primarily increasing density. In the case of powders and particulate additives, such materials may be produced by any process route that is used to form metal-matrix composites, such as, as examples, powder metallurgy (e.g. sintering).

Types of composites include functionally-graded materials, such as layered composites of alloys for instance, as well as the more traditional composites where the additives are uniformly distributed with a matrix. Types of additives for metal-matrix composites include continuous fibers, discontinuous fibers, particulates, powders, etc. Another advantage of the metal-matrix composites and cermets in aqueous environments is that the composite may readily form intragalvanic cells. Such cells may further accelerate the full degradation of the composite, leading to shorter degradation time than if the material of the matrix were used without additives. Such intragalvanic cells are formed in-situ an electrically conductive fluid environment by the presence of at least two phases that have different corrosion potentials. Examples of such composite is the tungsten aluminum composite earlier discussed. In that example, the aluminum phase is anodic and thus degrades while the tungsten is cathodic.

Another example of debris-free anodic material in accordance with embodiments of the invention is a ceramic-matrix composite (compositionally similar to a cermet, but the ceramic here acts as matrix, or binder), where the main additive includes a metal or alloy that has a negative corrosion potential and is unable to passivate (self-protect). As examples, the ceramic-matrix composite in accordance with embodiments of the invention, may include alkalines, alkaline-earth oxides, nitrides, etc. In general, ceramics shatter upon detonation due to their inherently poor toughness (or high brittleness). In order to minimize debris size, the ceramic material may be interrupted by the presence of an alloy that has a negative corrosion potential and is unable to passivate (self-protect). This alloy may be used to toughen the formed ceramic composite and expand its application range.

In accordance with some embodiments of the invention, the alloy may be designed to exhibit a poor toughness and thus exhibit a brittle-like behavior upon overloading/impact loading so that upon firing of the perforating system parts made of the alloy shatters in small and harmless debris. Over time the debris then fully degrades in the downhole environment, eventually leaving zero debris. In order to respond to dynamic loads, the alloy may incorporate unusually high fractions of brittle intermetallic phases. Suitable intermetallic phases may be generally recognized on equilibrium phase diagrams by their narrow composition ranges and high melting temperatures. From a thermodynamic standpoint, these intermetallic phases are the result of negative enthalpy of mixing, meaning that heat is spontaneously generated when these intermetallic phases form (i.e., exothermic reactions occur). Examples of brittle intermetallic phases may be found in aluminum—copper or aluminum calcium phase diagrams for instance.

In other embodiments of the invention, the debris free anodic material may be relatively strong prior to firing of the perforating system. However, once the charges are ignited and consequently temperature rapidly raises while a pressure spike is momentarily produced, phase transformations may occur within the material, thereby causing the material to weaken and fragment into fine (i.e. with large surface-to-volume ratios) debris in the terminal stages of perforating; i.e. after the jet has formed. The fragmentation of such brittle material into debris is also enhanced by the fact that the phases forming immediately after firing are brittle intermetallic phases that also have lattice parameters and/or volume expansions/contractions widely differing from the initial phases. In the presence of rapidly changing temperatures and stress (pressure) fields, the cracking, as assisted by the formation of new phases, may be useful, most specifically if this cracking originates fine debris that subsequently degrade in the fluid environment. In some embodiments of the invention, nano-materials (pure and unreacted copper nanoparticles in an aluminum matrix, as an example) may be used to produce secondary exothermic reactions giving rise to highly brittle materials. Thus, many variations are contemplated and are within the scope of the appended claims.

Figure 9:
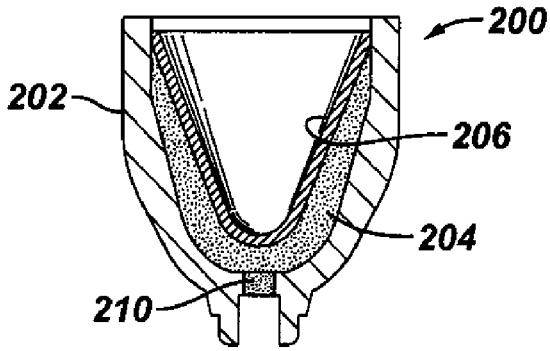
FIG. 9 is a cross-sectional view of an un-encapsulated shaped charge according to an embodiment of the invention.

The debris free anodic materials may be used in one or more components of a shaped charge in accordance with some embodiments of the invention. FIG. 9 generally depicts an unencapsulated shaped charge in accordance with some embodiments of the invention. In general, the shaped charge 200 includes a case 202, which forms a cup-like structure that houses an explosive 204 and a liner 206 that lines the interior surface of the explosive 204. The shaped charge 200 may include an additional explosive 210 that is fired in response to a detonation wave on a detonating cord (not depicted in FIG. 9) for purposes of firing the explosive 204. Thus, the firing of the explosive 210 initiates the firing of the explosive 204, to produce a perforation jet that penetrates the well casing (if the well is cased) and the formation rock.

Figure 10:
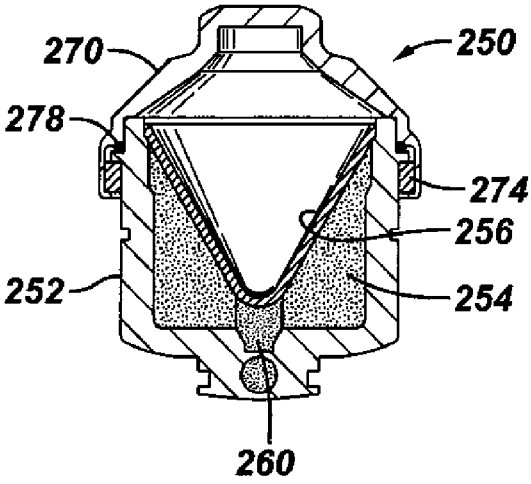
FIG. 10 is a cross-sectional view of an encapsulated shaped charge according to an embodiment of the invention.

It is noted that the shaped charge may be an encapsulated shaped charge, such as an encapsulated shaped charge 250 that is depicted for purposes of example in FIG. 10. The shaped charge 250 includes a case, which forms a cup-like structure for housing an explosive 254, which is lined by a liner 256. The shaped charge 250 also includes an explosive 260 that is fired in response to a detonation wave that occurs on a detonating cord (not depicted in FIG. 10). A cap 270 of the shaped charge 250 seals off the interior of the shaped charge 250 (i.e., the liner 256, explosive 254 and explosive 260). The cap 270 may be sealed to the case 252 via an o-ring 278. Additionally, a crimping ring 274 is crimped along with the outer periphery of the cap 270 for purposes of securing the cap 270 to the case 252.

In accordance with some embodiments of the invention, the zero debris material may be an essential building block to fabricate a zero debris shaped charge case. Therefore, due to this design, after detonation of the shaped charge, the debris is substantially totally degraded and leaves practically no residue inside the gun or wellbore. A higher density may be desired for the case for purposes of allowing the case to contain pressure longer and deliver more energy to the perforation jet to therefore enhance charge performance. To increase case density, a high density material, such as tungsten, may be added to a degradable material, thus forming a metal-matrix composite wherein the matrix or bonding agent is the degradable material. After the detonation, the bonding material degrades and the additive material is left in fine powder form, which does not cause any detrimental effects to subsequent well operations.

In accordance with some embodiments of the invention, the zero debris material may be used for a shaped charge liner. By using a high-density material in the liner, the perforation jet is enabled to reach deeper in the rock formation. In order to increase liner density, additives like tungsten powder may be incorporated to the liner. Because the material in the liner is degradable and is said to be zero-debris, the residual material that is often deposited in the bottom of the perforating tunnel is eliminated. If an additive, such as a fine tungsten power is used, the leftover powder has a relatively good permeability and may be flushed out of the tunnel.

The zero debris material, in accordance with embodiments of the invention, may likewise be employed in components of an encapsulated shaped charge, such as in the case, cap and/or liner. The benefits described above apply to using the material in one or more components of the encapsulated charge.

The zero debris material may be used as a supplementary heat source for purposes of increasing the perforation jet energy, in accordance with some embodiments of the invention. More specifically, in some embodiments of the invention, all of the components of the shaped charge, such as the case, liner, cap (if the charge is encapsulated) and even part of the explosive(s) may be made from the zero debris material for purposes of increasing the perforation jet energy. The zero debris material reacts quickly and affects the pressure power of the liner, which increases the perforation jet energy. In order to create a high level of exothermicity, transition metals and their semi-metallic phases may be added. A degradable aluminum gallium alloys incorporating fine and homogeneously distributed iron oxide may be used to produce thermite-like reactions for instance. Other additives may include metallic elements that once in contact with aluminum and gallium for instance would react exothermically. Examples of such elements are iron, titanium, nickel as well as copper. It is noted that nanoparticle size may be used for this effect, in accordance with some embodiments of the invention. Furthermore, by increasing the perforation jet energy, pressure inside the perforating gun, the wellbore and ultimately, the perforating tunnel may all be beneficially effective, thereby leading to superior charge performance and enhanced well productivity.

Figure 11:
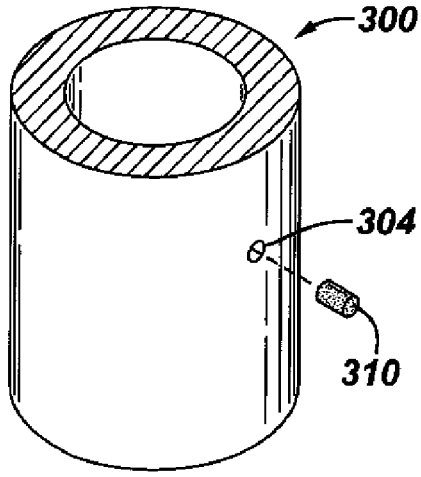
FIG. 11 is a schematic diagram of a firing head housing and an associated plug according to an embodiment of the invention.

Components of the perforating system other than the shaped charge and its subcomponents may be formed from the zero debris material in accordance with embodiments of the invention. For example, the zero debris material may be used as a plug material on a gun/firing head housing that is exposed to the well fluid. In this regard, referring to FIG. 11, in accordance with some embodiments of the invention, the firing head 52 (see FIG. 1) or 62 (see FIG. 2) may contain a housing 300 with a port 304 that establishes communication between an interior space (a space containing a rupture disc or pressure sensor, as examples) of the housing 300 and well fluid in the surrounding annulus. Initially, fluid communication through the port 304 is closed by a plug 310, which may be formed from the zero debris material. After the plug 310 is exposed to the wellbore fluid (such as water, for example), the plug 310 begins to dissolve. After a certain interval of time elapses, the plug 310 becomes thinner and eventually collapses under the wellbore pressure to allow communication between the interior space of the firing head housing 300 and the wellbore.

The pressure inside the firing head housing 300 is equalized if a sufficiently high pressure exists inside the perforating gun. In this regard, sometimes, a loaded gun string may stay downhole at elevated temperatures for a significantly long time period, which exceeds the time duration specification for the perforating gun. When this occurs, the explosive inside the perforating gun partially or completely degrades, and the pressure inside the gun becomes significantly high. At this point, the perforating gun may malfunction, and even if the gun is fired, the perforating charge holes in the gun may be plugged and high pressure gas may be trapped inside the gun. Thus, via the port 304 and associated plug 310, any trapped high pressure gas inside the perforating gun is relieved before the gun is brought the surface to prevent a hazardous situation from occurring. After the plug 310 dissolves to establish communication between the interior space of the firing head housing 300 and the wellbore (via the port 304), the wellbore pressure may be controllably increased for purposes of, for example, firing the perforating gun.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a well, comprising:

a perforating system adapted to be fired downhole a well and comprising a component incorporating an alloy having a negative corrosion potential and not being able to passivate, the component adapted to disintegrate to form substantially no debris in response to the firing of the perforating system.

2. The apparatus of claim 1, wherein said substantially no debris consists essentially of individual fragments of about sand grain sizes and/or dissolved materials.

3. The apparatus of claim 1, wherein the alloy comprises an alloy of aluminum containing gallium, indium and optionally tin and bismuth so that the alloy is anodic and does not passivate so as to self-degrades in aqueous well fluids.

4. The apparatus of claim 1, wherein the alloy comprises any alloy of calcium, or alloys of magnesium and alkaline metals with the proviso that the alloy is anodic and does not passivate so as to self-degrade in aqueous well fluids.

5. The apparatus of claim 1, wherein the component comprises a metal-matrix composite having a matrix comprising an alloy leaving substantially no debris and additives bound by this alloy-made matrix.

6. The apparatus of claim 5, wherein the perforating system comprises perforating charges and the additives comprise heavy metals or semi-metallic heavy metal phases to raise density of perforating charges.

7. The apparatus of claim 5, wherein the additives are used as mechanical reinforcements and comprise silica, silicone carbide, alumina, boron carbide among other oxides, carbides, nitrides and combinations thereof.

8. The apparatus of claim 1, wherein the component comprises a ceramic-matrix composite.

9. The apparatus of claim 8, wherein the ceramic matrix comprises an alkaline and alkaline-earth oxides, nitrides, or other reactive and water-soluble ceramic-like materials.

10. The apparatus of claim 1, wherein the alloy is adapted to develop a brittle and highly fragmentable structure upon firing of the perforating system, as triggered by the formation of brittle intermetallic phase within the alloy.

11. The apparatus of claim 1, wherein the component comprises a component of a shaped charge.

12. The apparatus of claim 11, wherein the component of the shaped charge comprises a liner, a case, a cap and/or an explosive.

13. The apparatus of claim 1, wherein the perforating system comprises a firing head housing, and the component comprises a plug to block communication between a well annulus and an interior space of the firing head housing prior to the firing of the perforating system and allow communication between the well annulus and the interior space of the firing head housing in response to the firing of the perforating system.

14. A method usable with a well, comprising:

providing a perforating system downhole in the well;

firing at least one perforating charge of the perforating system; and in response to the firing, disintegrating a component of the perforating system having an alloy having a negative corrosion potential and being unable to passivate.

15. The method of claim 14, wherein said substantially no debris consists essentially of individual fragments of about sand grain sizes and/or dissolved materials.

16. The method of claim 14, wherein the component comprises a metal-matrix composite and the matrix comprises the alloy.

17. The method of claim 14, wherein the component comprises a ceramic-matrix composite and the matrix comprises the alloy.

18. The method of claim 14, further comprising:

designing and processing the alloy so that the alloy is brittle prior to firing of the perforating system.

19. The method of claim 14, wherein the act of disintegrating the component comprises disintegrating a component of a shaped charge.

20. The method of claim 19, wherein the component of the shaped charge comprises a liner, a case, a cap and/or an explosive.

21. The method of claim 14, further comprising:

using the disintegration of the component to increase a jet energy of the shaped charge.

22. The method of claim 21, further comprising:

providing an alloy having a negative corrosion potential in at least one additional component of the shaped charge; and using disintegration of the alloy in said at least one additional component to increase a jet energy of the shaped charge.

23. The method of claim 14, wherein the perforating system comprises a firing head housing, and the component comprises a plug to block communication between a well annulus and an interior space of the firing head housing prior to the firing of the perforating system, and the act of disintegrating comprises disintegrating the plug in response to the firing of the perforating system.

* * * * *